US006761231B1

(12) United States Patent
Dock et al.

(10) Patent No.: US 6,761,231 B1
(45) Date of Patent: Jul. 13, 2004

(54) ROTARY DRIVEN DRILLING HAMMER

(75) Inventors: Matthew L. Dock, Stillwater, OK (US); Richard Felix Sharp, Perry, OK (US); Floyd R. Gunsaulis, Perry, OK (US)

(73) Assignee: The Charles Machines Works, Inc., Perry, OK (US)

( * ) Notice: Subject to any disclaimer, the term of this patent is extended or adjusted under 35 U.S.C. 154(b) by 70 days.

(21) Appl. No.: 10/139,304

(22) Filed: May 6, 2002

(51) Int. Cl.[7] ..... E21B 1/00

(52) U.S. Cl. ..... 175/51; 175/74; 175/107; 175/298

(58) Field of Search ..... 175/203, 51, 73, 175/74, 92, 106, 107, 113, 135, 162, 293, 296, 298

(56) References Cited

U.S. PATENT DOCUMENTS

| | | | | | |
|---|---|---|---|---|---|
| 3,835,943 | A | * | 9/1974 | Bray | 175/135 |
| 3,896,886 | A | * | 7/1975 | Roscoe, Jr. | 173/17 |
| 3,952,813 | A | | 4/1976 | Chepurnoi et al. | 173/91 |
| 4,030,554 | A | * | 6/1977 | Kammerer et al. | 173/17 |
| 4,632,191 | A | | 12/1986 | McDonald et al. | 175/19 |
| 4,683,960 | A | | 8/1987 | Kostyle et al. | 173/91 |
| 4,694,913 | A | | 9/1987 | McDonald et al. | 175/61 |
| 4,834,193 | A | | 5/1989 | Leito, Jr. et al. | 175/19 |
| 4,907,658 | A | | 3/1990 | Stangl et al. | 175/19 |
| 5,065,827 | A | | 11/1991 | Meyers et al. | 175/414 |
| 5,226,487 | A | | 7/1993 | Spektor | 175/19 |
| 5,505,270 | A | | 4/1996 | Wentworth | 173/1 |
| 5,782,311 | A | | 7/1998 | Wentworth | 175/53 |
| 5,803,187 | A | | 9/1998 | Javins | 175/57 |
| RE36,166 | E | * | 3/1999 | Johns et al. | |
| 5,954,145 | A | | 9/1999 | Hesse et al. | 175/19 |
| RE36,848 | E | * | 9/2000 | Bui et al. | |
| 6,371,223 | B2 | | 4/2002 | Wentworth et al. | 175/296 |
| 6,390,207 | B2 | | 5/2002 | Wentworth et al. | 175/61 |
| 6,439,319 | B1 | | 8/2002 | Wentworth et al. | 175/61 |
| 6,454,025 | B1 | | 9/2002 | Runquist et al. | 175/61 |
| 6,659,202 | B2 | | 12/2003 | Runquist et al. | 175/61 |
| 2002/0043406 | A1 | | 4/2002 | Wentworth et al. | 175/61 |
| 2002/0084109 | A1 | | 7/2002 | Runquist et al. | 175/61 |
| 2003/0024739 | A1 | | 2/2003 | Runquist et al. | 175/61 |
| 2003/0230430 | A1 | | 12/2003 | Martini | 175/57 |
| 2003/0230434 | A1 | | 12/2003 | Binon et al. | 175/415 |

FOREIGN PATENT DOCUMENTS

| | | | |
|---|---|---|---|
| DE | 42 25 701 C1 | 12/1993 | E21B/7/20 |
| WO | WO 02/055835 A1 | 7/2002 | E21B/7/04 |

* cited by examiner

*Primary Examiner*—Roger Schoeppel
(74) *Attorney, Agent, or Firm*—McKinney & Stringer, P.C.

(57) ABSTRACT

A percussive tool adapted to receive rotational energy from the inner member of a dual-member drill string. In a preferred embodiment the percussive tool has a hydraulic pump, driven by a drive member, to operate the hammer assembly. In another preferred embodiment the percussive tool has a rotary-driven cam assembly adapted to mechanically operate the hammer assembly. This invention provides increased control and efficiency for the use of percussive force in horizontal directional drilling operations.

24 Claims, 7 Drawing Sheets

ROTARY DRIVEN DRILLING HAMMER

FIELD OF THE INVENTION

This invention relates generally to drilling hammers, and in particular to downhole hammers for use in horizontal directional drilling operations.

BACKGROUND OF THE INVENTION

During horizontal directional drilling operations hard soil or rock may impede the progress of borehole formation. Percussive tools driven by hammer assemblies are sometimes used to fracture such subterranean formations. However, there remains a need for improvement.

SUMMARY OF THE INVENTION

The present invention comprises a percussive tool for use with a dual-member drill string. The dual-member drill string comprises an outer member and an inner member. The inner member is rotatable independently of the outer member. The percussive tool comprises a housing connectable with the drill string and a drive member rotatably supported within the housing. The drive member is connectable with the inner member of the drill string. A hammer assembly is supported by the housing and operable in response to rotation of the drive member.

The present invention further comprises a percussive tool for use in a borehole. The tool comprises a housing and a drive member rotatably supported within the housing. A hammer assembly is supported by the housing. The hammer assembly comprises a hydraulic pump assembly and a hammer unit. The pump assembly operates in response to rotation of the drive member and is adapted to power operation of the hammer unit.

Still further, the present invention comprises a horizontal directional drilling machine. The horizontal directional drilling machine comprises a rotary drive system and a drill string. The drill string has a first end and a second end. The first end of the drill string is operatively connected to the rotary drive system. The drill string comprises a dual-member drill string having an outer member and an inner member. The inner member is independently rotatable of the outer member. A percussive tool comprising a hammer assembly is operatively connected to the second end of the drill string so that rotation of the inner member will drive operation of the tool.

Finally, the present invention includes a method of underground horizontal directional drilling. The method using a horizontal directional drilling machine. The horizontal directional drilling machine includes a rotary drive system and a dual-member drill string. The dual-member drill string has a first end and a second end. The rotary drive system is attached to the first end of the drill string. The drill string comprises an outer member and an inner member. The inner member is rotatable independently of the outer member. The machine further comprises a percussive tool. The percussive tool is attached to the second end of the drill string. A bit is supported on the percussive tool. The percussive tool comprises a hammer assembly for driving the bit. The method comprises operating the hammer assembly by rotating the inner members.

BRIEF DESCRIPTION OF THE DRAWINGS

FIG. 6A is an enlarged view of the cam assembly taken from within the dashed square of FIG. 5 showing the cam faces substantially together.

FIG. 6B is an enlarged view of the cam assembly taken from within the dashed square of FIG. 5 showing the cam faces substantially separated.

DETAILED DESCRIPTION OF THE PREFERRED EMBODIMENTS

Figure 1:
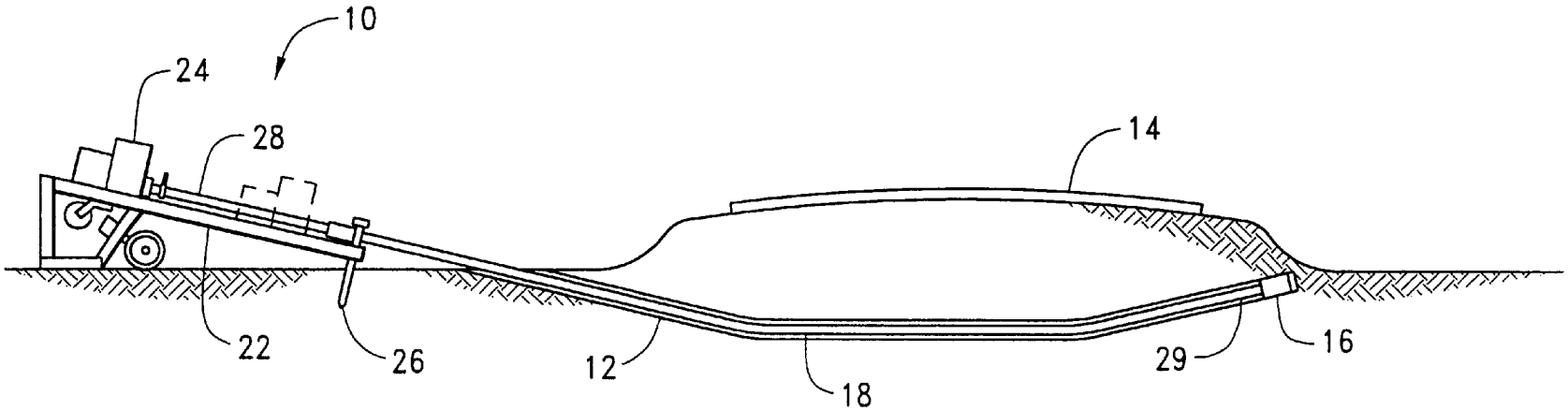
FIG. 1 is a diagrammatic representation of a near surface horizontal directional drilling machine acting on an uphole end of a drill string that, in turn, supports a percussive tool constructed in accordance with the present invention.

Turning now to the drawings in general and FIG. 1 in particular, there is shown therein a horizontal directional drilling machine 10 constructed in accordance with the present invention. FIG. 1 illustrates the usefulness of horizontal directional drilling by demonstrating that a borehole 12 can be made without disturbing an above-ground structure, namely the roadway as denoted by reference numeral 14. FIG. 1 also illustrates the present invention by showing the use of a percussive tool 16, comprising a hammer assembly, operatively connected to a drill string 18 and adapted to generate fractures in hard soil or rock formations.

Referring still to FIG. 1, the horizontal directional drilling machine 10 generally comprises a frame 22, for supporting a rotary drive system 24, and an earth anchor 26. The rotary drive system 24 is movably supported on the frame 22 between a first position and a second position. Movement of the rotary drive system 24, by way of an axial advancement means (not shown), between the first position and the second position axially advances the drill string 18 and percussive tool 16 through the borehole 12. The earth anchor 26 is driven into the earth to stabilize the frame 22 against the axial force exerted by movement of the rotary drive system 24 during axial advancement of the percussive tool 16.

The drill string 18 is operatively connected to the rotary drive system 24 at a first end 28. The percussive tool 16 is operatively connected to the second end 29 of the drill string 18. In the present invention the drill string 18 transmits torque and thrust to the percussive tool 16 to fracture the subterranean formation.

Figure 2:
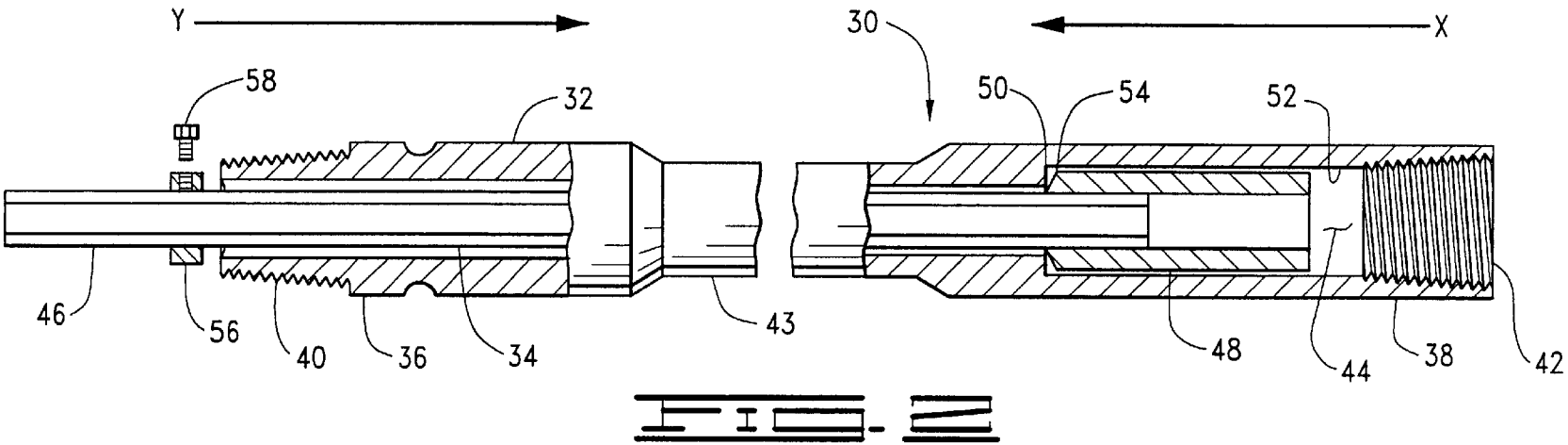
FIG. 2 is a fragmented, side elevational, partly sectional view of a first type pipe section used with a dual-member drill string.

In accordance with the present invention, it is preferable to utilize a dual-member drill string. The dual-member drill string 18 may comprise a plurality of dual-member pipe sections or pipe joints. Turning now to FIG. 2, there is shown one of a plurality of dual-member pipe sections 30 comprising the dual-member drill string 18. The dual-member pipe section 30 comprises a hollow outer member 32 and an inner member 34 positioned longitudinally therein. The inner member 34 and outer member 32 are connectable with the inner members and outer members of adjacent dual-member pipe sections to form the dual-member drill string 18. The interconnected inner members 34 are rotatable independently of the interconnected outer members 32 to drive operation of the percussive tool 16. It will be appreciated that any dual-member pipe section capable of connecting to adjacent sections of dual-member pipe may be used, but for purposes of illustration a discussion of two alternative dual-member pipe sections 30 and 30A follows.

Referring still to FIG. 2, the outer member 32 is preferably tubular having a pin end 36 and a box end 38. The pin end 36 and box end 38 are threaded for connection with correspondingly threaded adjacent sections of pipe. The pin end 36 is provided with tapered external threads 40, and the box end 38 is provided with tapered internal threads 42. Thus, the box end 38 of the outer member 32 is connectable to the pin end 36 of a like dual-member pipe section 30. Similarly, the pin end 36 of the outer member 32 is connectable to the box end 38 of a like dual-member pipe section 30.

The external diameter of the pin end 36 and the box end 38 of the outer member 32 may be larger than the external diameter of the central body portion 43 of the outer member 32. The box end 38 of the outer member 32 forms an enlarged internal space 44 for a purpose yet to be described.

The inner member 34 is preferably elongate. In the dual-member pipe section 30, the inner member 34 is integrally formed and comprises a tubular member. However, it will be appreciated that in some instances a solid inner member 34 may be satisfactory.

The inner member 34 is provided with a geometrically-shaped pin end 46 and with a box end 48 forming a geometrically-shaped recess corresponding to the shape of the pin end 46. As used herein, "geometrically-shaped" denotes any configuration that permits the pin end 46 to be slidably received in the box end 48 and yet transmit torque between adjacent inner members 34. The geometrically-shaped pin end 46 and box end 48 of the adjoining member (not shown) prevent rotation of the pin end 46 relative to the box end when thus connected. A preferred geometric shape for the pin end 46 and box end 48 of the inner member 34 is a hexagon. The box end 48 of the inner member 34 may be brazed, forged or welded or attached to the inner member 34 by any suitable means.

Continuing with FIG. 2, the box end 48 of the inner member 34 is disposed within the box end 38 of the outer member 32. It will now be appreciated that the box end 38 of the outer member 32 forms an enlarged internal space 44 for housing the box end 48 of the inner member. This arrangement facilitates easy connection of the dual-member pipe section 30 with the drill string 18 and the rotary drive system 24.

It is desirable to construct the dual-member pipe section 30 so that the inner member 34 is slidably insertable in and removable from the outer member 32. This allows easy repair and, if necessary, replacement of the inner member 34. However, longitudinal movement of the inner member 34 within the outer member 32 must be restricted in the assembled dual-member pipe section 30. Accordingly, stop devices are provided in the dual-member pipe section 30.

An annular shoulder 50 is formed on the inner surface 52 of the outer member 32 to limit longitudinal movement of the inner member 34 within the outer member 32. In addition, the box end 48 of the inner member 34 forms a shoulder 54 which is larger than the annular shoulder 50. Thus, when the inner member 34 is moved in direction X, the shoulder 54 abuts annular shoulder 50 preventing further movement in that direction.

Longitudinal movement of the inner member in direction Y is restricted by providing a radially projecting annular stop member 56. The pin end 46 of the inner member 34 extends a distance beyond the pin end 36 of the outer member 32. The stop member 56 is disposed near the pin end 46 of the inner member 34 beyond the pin end 36 of the outer member 32. As shown in exploded view in FIG. 2, the radially projecting annular stop member preferably comprises a collar 56 and a set screw or pin 58. When the inner member 34 is moved in direction Y, the stop collar 56 abuts the pin end 36 of the outer member 32 and obstructs further movement.

Figure 3:
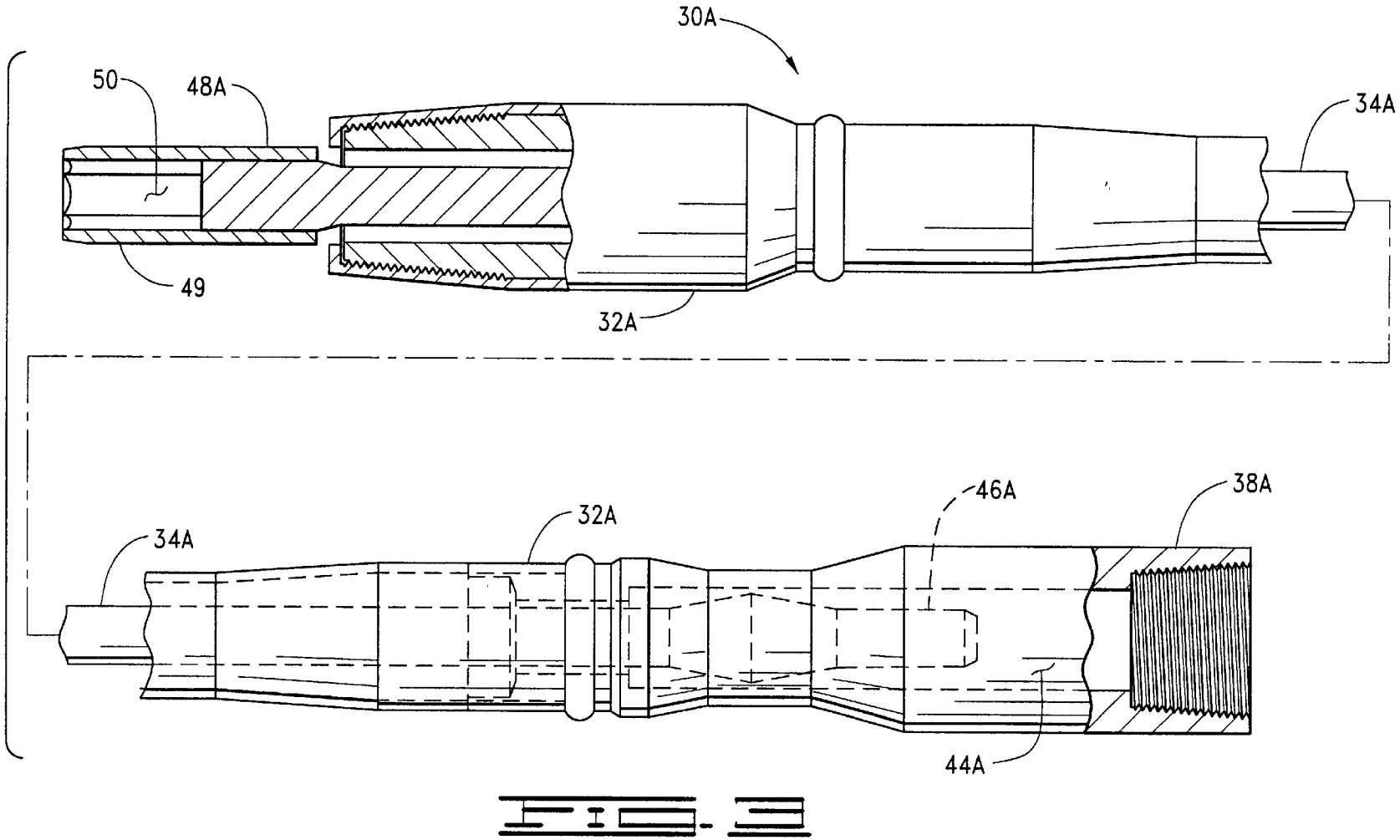
FIG. 3 is a fragmented, side elevational, partly sectional view of an alternative type of pipe section used with a dual-member drill string. In this type of pipe section, the pin end and box end on the inner member are reversed.

Turning now to FIG. 3, there is shown an alternative dual-member pipe section 30A. The pipe section 30A comprises a hollow outer member 32A and an inner member 34A positioned longitudinally therein. The inner member 34A is preferably elongate having a pin end 46A and a box end 48A. As previously discussed with regard to dual-member pipe section 30, the pin end 46A and box end 48A may be geometrically-shaped to transmit torque between adjacent pipe sections.

The geometrically-shaped pin end 46A of pipe section 30A is disposed within the box end 38A of the outer member 32A. The box end 38A of the outer member 32A forms an enlarged internal space 44A for receiving the box end 48A of a similarly formed dual-member pipe section.

The inner member 34A is positioned within the outer member 32A so as to extend to an external point beyond the pin end 36A of the outer member. The inner member box end 48A is formed by a geometrically-shaped drive collar 49 connected to the external portion of the inner member 34A. The drive collar 49 is preferably attached to the inner member using a roll pin (not shown), but may be attached to the inner member 34 by any other suitable means. The drive collar 49 has an internal geometrically-shaped bore 50 which corresponds with the geometrically-shaped pin end 46A of the inner member 34A. Use of geometrically-shaped drive collar 49 provides a connection capable of transmitting torque between adjacent pipe sections 30A and ultimately to the percussion tool 16.

Figure 4:
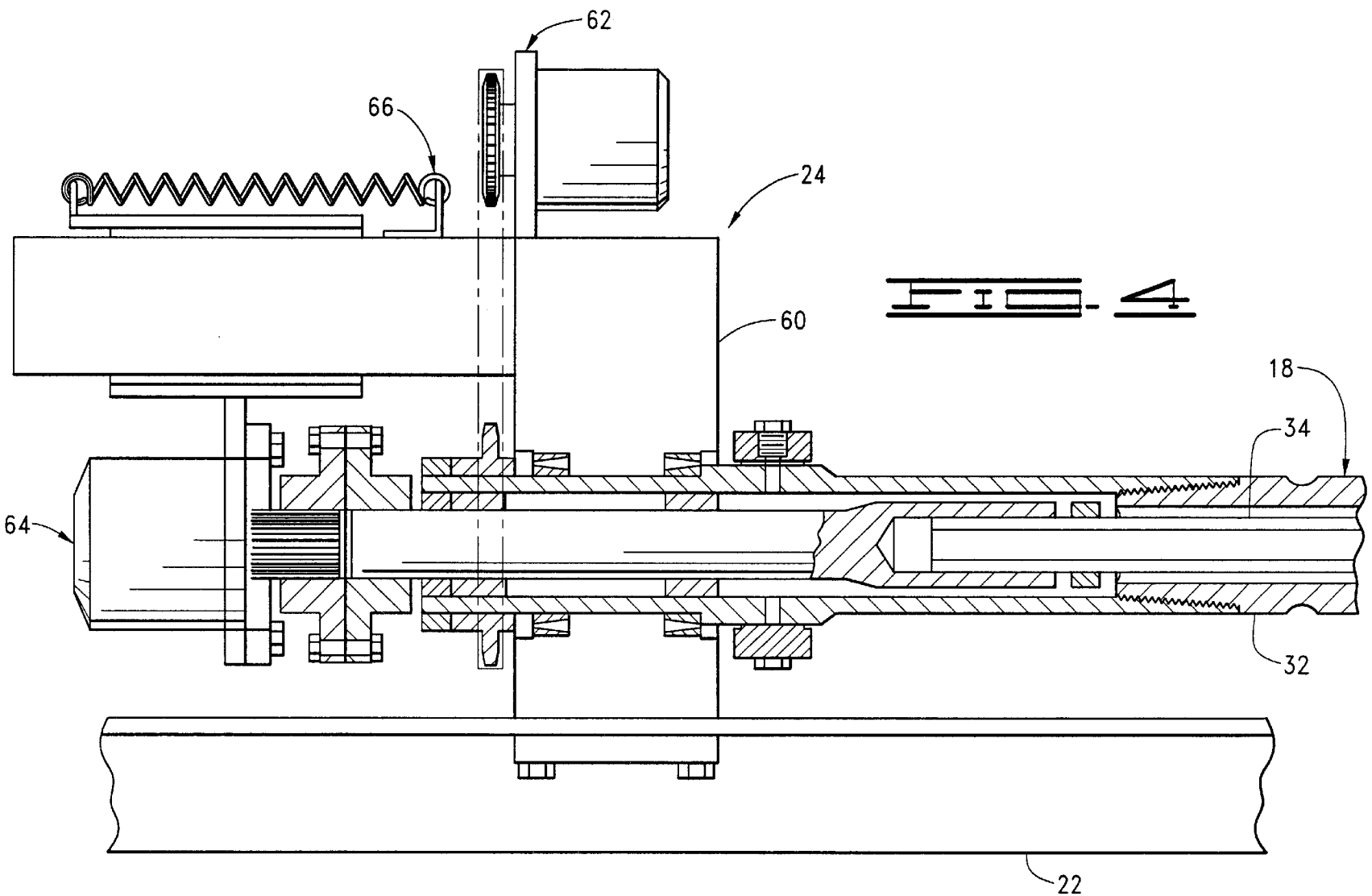
FIG. 4 shows a fragmented, side elevational, cross-sectional view of the rotary drive system of the present invention.

Turning now to FIG. 4, the rotary drive system 24 for driving operation of the percussive tool 16 is shown in more detail. Because the outer member 32 and inner member 34 rotate independently of each other, the rotary drive system 24 has two independent drive groups for independently driving the interconnected outer members and interconnected inner members comprising the drill string 18.

The rotary drive system 24 thus preferably comprises a carriage 60 supported on the frame 22. Supported by the carriage 60 is an outer member drive group 62 and an inner member drive group 64. The outer member drive group 62 drives the interconnected outer members 32. The inner member drive group 64, also called the inner member drive shaft group, drives the interconnected inner members 34 and the percussive tool 16. The rotary drive system 24 also comprises a biasing assembly 66 for urging engagement of the inner members. A suitable rotary drive system 24 having an outer member drive group 62 for driving the interconnected outer members 34 and an inner member drive group 64 for driving the interconnected inner members 34 is disclosed in U.S. Pat. No. 5,682,956, which is incorporated herein by reference.

Figure 5:
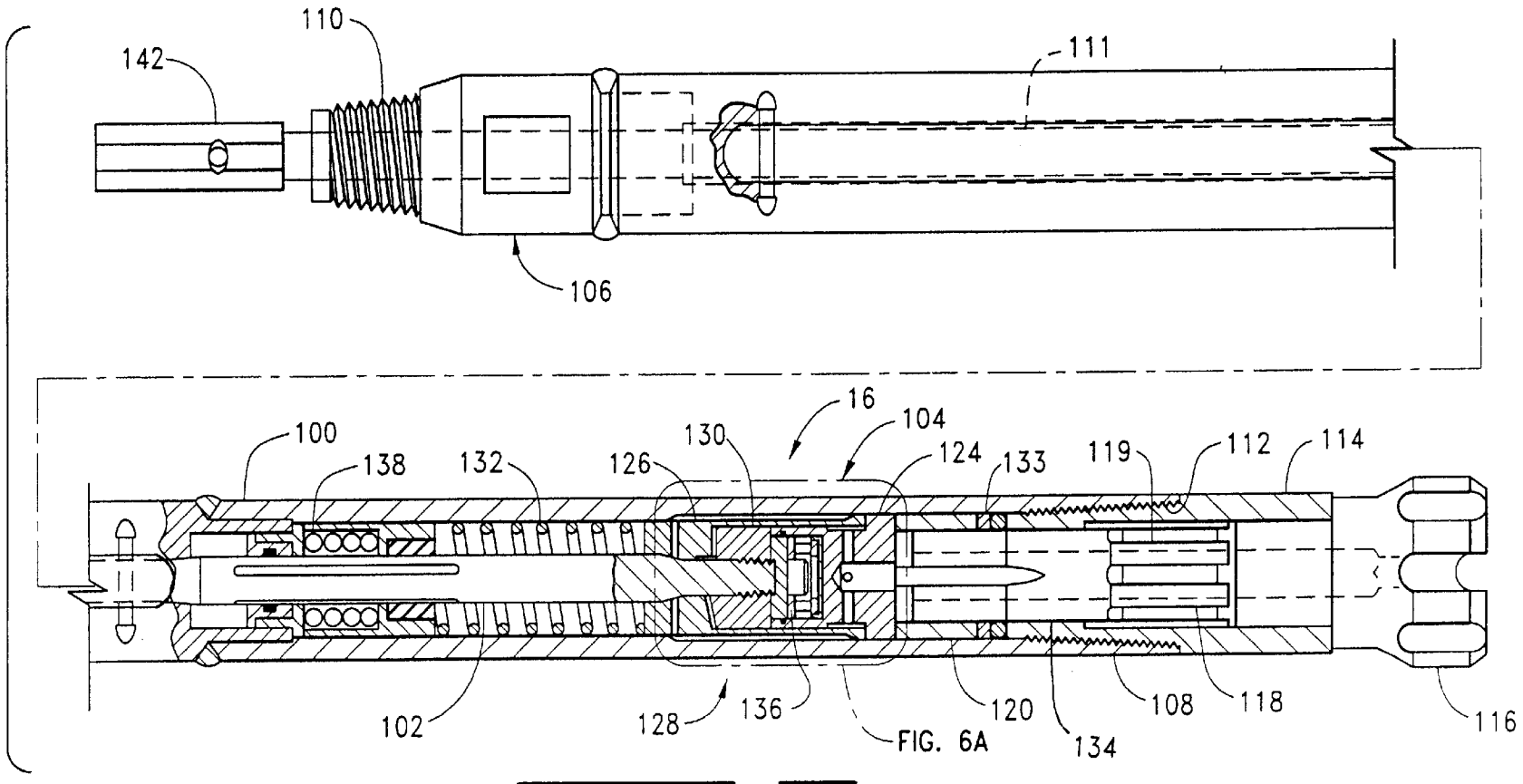
FIG. 5 is a side elevational, partly sectional view of a percussive tool in accordance with the present invention. The percussive tool of FIG. 5 has a mechanically-operated hammer unit.
Figure 5A:
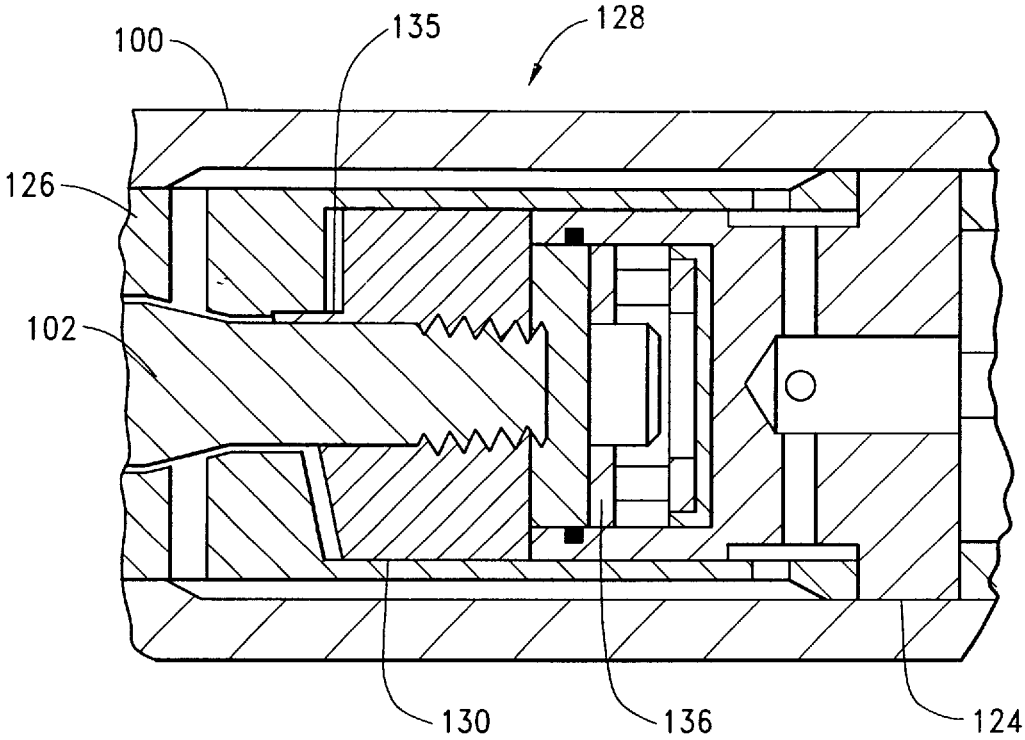
Figure 5B:
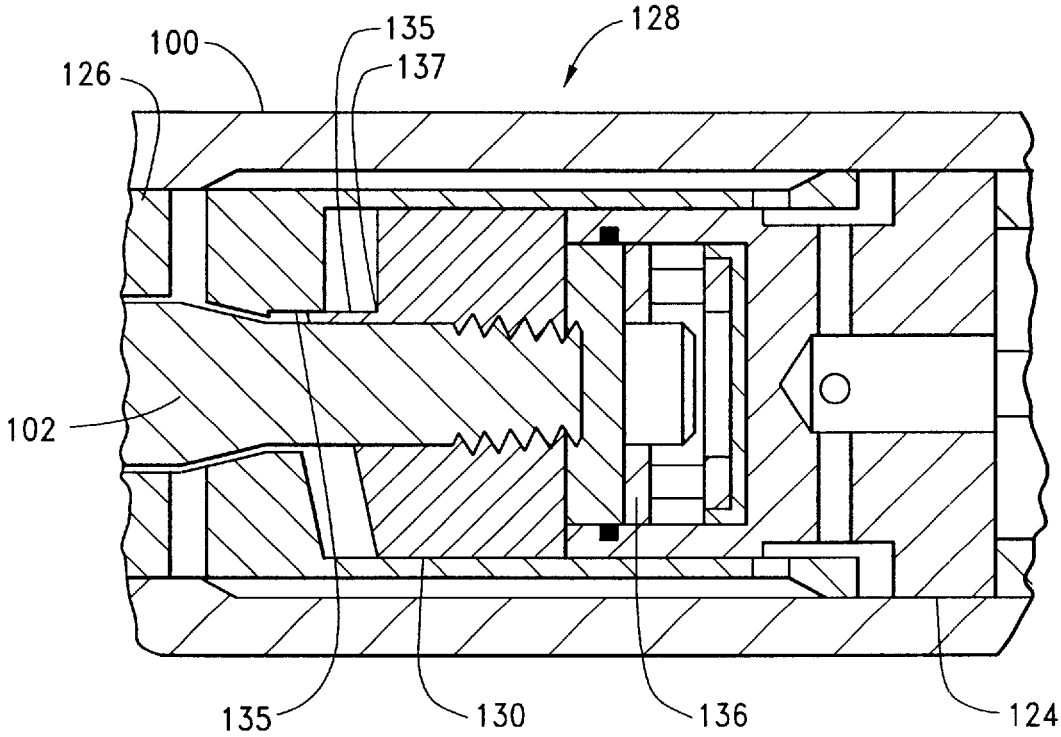

Turning now to FIGS. 5, 6A and 6B, there is illustrated therein a first embodiment of a percussive tool 16 constructed in accordance with the present invention. The percussive tool of FIG. 5 comprises a mechanically-driven hammer assembly.

The percussive tool 16 comprises a housing 100 having a drive member 102 rotatably supported therein. The drive member 102 is operatively connected to a hammer assembly 104, and operable to drive the tool in response to rotation of the inner member. The housing 100 is preferably elongate having a tail piece 106 at one end and a box end 108 at the opposite end. The box end 108 comprises internal threads 112 for connecting the housing 100 to a chuck 114.

The tail piece 106 forms a pin end having external threads 110 for connecting to corresponding internal threads 42A of the outer member 32A (FIG. 3) of an adjacent dual member pipe section 30A (FIG. 3). The tail piece 106 and the housing 100 may form a bent sub. The bent sub is formed by connecting the housing 100 and tail piece 106 so that a slight angle of 1° to 3° is formed between the two components. The bent sub is used for steering the tool 16 through the borehole. Accordingly, a transmitter beacon 111 may be employed to provide orientation and location information to the operator. In response to orientation information the operator is able to properly orient the tool 16 for steering.

The chuck 114 is threadedly connected to the box end 108 of the housing 100 and connects a bit 116 to the housing. Internal splines 118 formed on the interior surface of the chuck 114 engage internal spline groove 119 to prevent rotation of the bit 116 relative to the chuck. After the bit 116 is inserted into the chuck 114, and before the chuck is connected to the housing 100, a split retaining ring 120 is placed over the shank of the bit. The split retaining ring 120 prevents the bit from being withdrawn from the housing 100 during operation. The bit 116 is rotatably driven by the interconnected outer members 32, and the bit 116 is adapted to receive impact force from an anvil 124. While a conventional impact hammer bit has been shown in FIG. 5, it will be appreciated that a slant-faced boring head and bit may be used to form the borehole and steer the tool.

The hammer assembly 104 preferably comprises a rotary-driven cam assembly 128 operatively connected to the drive member 102 and adapted to drive the percussive tool 16 in response to rotation of the inner member. The cam assembly 128 comprises a lower cam 130 and an upper cam 126. The lower cam 130 and upper cam 126 have opposing, helically-contoured interengaging faces so that rotation of the one against the other forces the faces a distance apart. Alternatively, the cam faces may be contoured such that full rotation of the drive member 102 will cause multiple cycles of the faces being forced apart and back together. Preferably, each cam face has two ramps 135 (FIG. 6) to produce two cycles during one rotation of the drive member 102. However, it will be appreciated that the number of ramps may be varied to alter the number of cycles.

A biasing means comprising a coil spring 132 is compressed in response to axial movement of the upper cam 126 away from the lower cam 130; and therefore urges the upper cam 126 axially toward the lower cam 130 when the opposing cam faces are aligned. Alternatively, the biasing means may comprise a series of conical spring washers, an elastomeric spring or any other means for urging engagement of the opposing cam faces.

Continuing with FIG. 5, a urethane ring 133 is provided to limit the impact force transmitted to the housing 100 and chuck 114 if the upper cam 126 is allowed to impact the anvil 124 when the anvil is not in contact with the bit 116. The use of urethane ring 133 prolongs the useful life of the housing 100 and chuck 114 by preventing excessive wear.

The upper cam 126 is non-rotatably supported by the housing 100 for axial movement away from the lower cam 130 in response to rotation of the drive member 102. The upper cam 126 is formed to impact the anvil 124 as the lower cam 130 is rotated with the drive member 102, relative to the upper cam.

The drive member 102 is rotated by the rotary drive system 24 (FIG. 1) to drive rotation of the lower cam 130 and thus separate the opposing faces (FIG. 6B) of cams 126 and 130 while compressing the coil spring 132. As the drive member 102 is rotated, the opposing ramps 135 rotate so that the crests of at least two of the opposing ramps pass each other and fall into a valley 137 formed by the opposing ramp. The falling action causes the biasing means 132 to urge the upper cam 126 towards the anvil 124. Therefore, continuous rotation of the drive member 102 generates repetitive percussive force between the upper cam 126 and the anvil 124. The anvil 124 then communicates impacts from the upper cam 126 to the upper end 134 of the bit 116. The impacts are thusly transferred to the borehole engaging surface of the bit 116 to create fractures in the subterranean formation.

Now it will be appreciated that, as the lower cam 130 is rotated by the drive member 102, the anvil 124 and lower cam 130 are in sliding contact. To prevent excessive torque of the drive member 102 resulting from contact between the lower cam 130 and the anvil 124, a thrust bearing 136 is inserted between the lower cam and the anvil.

Continuing with FIG. 5, the drive member 102 is rotatably supported within the housing 100. Bearings 138 encourage longitudinal rotation of the drive member 102 within the housing 100. The drive member 102 has a geometrically-shaped coupling member 142 extending beyond the pin end 106 to connect the inner member to an adjacent dual-member pipe section. As previously discussed, using geometrically-shaped coupling member 142 allows for efficient connection of the drive member 102 to the inner member 34A of adjacent pipe sections and facilitates the transmission of torque down the drill string 18. Now it will be apparent that the use of the geometrically-shaped coupling member 142 to connect the inner member 34A of the drill string 18 to the percussive tool 16 is preferred, but may be accomplished using several different means.

Figure 7:
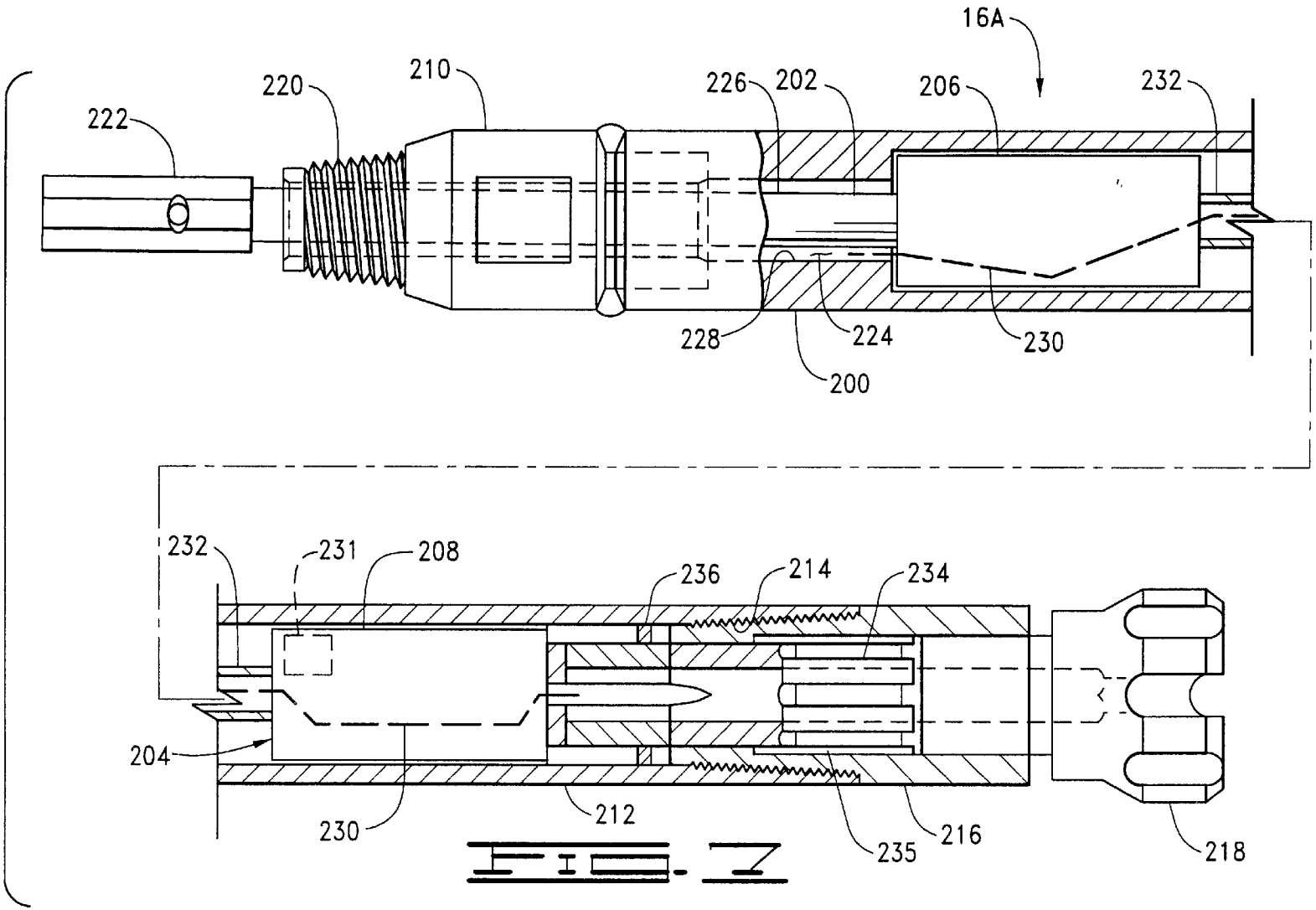
FIG. 7 is a side elevational, partly sectional view of a percussive tool in accordance with the present invention. The percussive tool of FIG. 7 has a hydraulically-operated hammer unit.

Turning now to FIG. 7, there is illustrated therein an alternative embodiment of the present invention. The percussive tool 16A comprises a housing 200 having a drive member 202 rotatably supported within the housing. The percussive tool 16A further comprises a hydraulic hammer assembly 204. The hydraulic hammer assembly 204 is supported by the housing 200 and preferably comprises a hydraulic pump 206 and hammer unit 208. The hydraulic pump 206 is rotatably driven by the drive member 202 to generate hydraulic power for driving the hammer unit 208.

Continuing with FIG. 7, the hammer assembly 204 comprising the hydraulic pump 206 and hammer unit 208 are supported within the housing 200. The housing 200 is preferably elongate having tailpiece 210 at one end and a box end 212 at the opposite end. The box end 212 comprises internal threads 214 for connecting the housing 200 to a chuck 216 holding the bit 218.

The tail piece 210 forms a pin end having external threads 220 for connecting to corresponding internal threads 42A of the outer member 32A (FIG. 3) of an adjacent dual-member pipe section 30A (FIG. 3). In some applications it may be desirable to have a tailpiece 210 connected to the housing 200 at a slight angle. The angle, preferably in the range of 1° and 3°, between the tailpiece 210 and the housing 200 will produce an off-center bias of the bit 218 within the borehole 12 (FIG. 1). This off-center bias will allow the operator to selectively steer the tool as it is axially advanced through the borehole. Steering is accomplished by oscillating the angular orientation of the housing 100 about a narrow sector of rotation as the housing is axially advanced. A beacon for transmitting tool orientation information may be supported within the housing 200 to assist the operator with steering the tool 16A.

The drive member 202 is rotatably supported within the housing 200. Preferably, the drive member 202 has a coupling member 222 connected to the external portion of the drive member 202. The coupling member 222 is formed to provide a torque-transmitting connection between the percussive tool 16A and the dual-member drill string 18 (FIG. 1). Use of the coupling member 222, having an internally formed geometrically-shaped recess, allows for efficient connection of the drive member 202 to the adjacent pipe sections comprising the drill string 18 and facilitates torque transmission down the drill string. Now it will be apparent that use of a geometrically-shaped coupling member 222 to connect the inner members 34A of the drill string 18 to the percussive tool 16A is preferred, but may be accomplished by other means.

A fluid passage 224 is formed between the external wall 226 of the drive member 202 and the inner wall 228 of the housing 200 for transporting drilling fluid to the hydraulic pump 206. Drilling fluid is passed from the boring machine 24 (FIG. 1) by a fluid pump (not shown) through the housing 200 into the hydraulic pump assembly 206, where it is pressurized for use by the hammer unit 208. Alternatively, the hydraulic pump 206 and hammer unit 208 could be connected by a closed hydraulic system and utilize hydraulic fluid separate from the drilling fluid. Rotation of the drive member 202 is used by the hydraulic pump 206 to create the fluid pressure necessary to drive the hammer unit 208. Pressurized fluid then flows, as shown by the dashed line 230, to the hammer unit 208 via a conduit 232. A control unit 231 within the hammer unit 208 may be used to receive remote commands for regulating operation of the hammer unit.

The chuck 216 is threadedly connected to the box end 212 of the housing 200 and connects the bit 218 to the housing 200. Internal splines 234 formed on the interior surface of the chuck 216 engage spline grooves 235 and prevent rotation of the chuck relative to the bit 218 during operation of the hammer assembly 204.

The bit 218 is rotatably driven by the interconnected outer members as the hammer unit 208 operates to impact the rock face with percussive force to fracture the subterranean formation. The hammer assembly 204 is adapted to transfer impact force from the hammer unit 208 to the end of the bit 218 contained within the housing 200.

Now it will be appreciated that because the outer member and inner member are rotatable independently of each other, the operator (not shown) may control operation of either percussive tool 16 or 16A independent of the bit. In operation, the inner member is rotated independently of the outer member to operate the percussive tools 16 and 16A and thus provide the fracturing action necessary to create the borehole 12.

The present invention also comprises a method for underground horizontal directional drilling using a horizontal directional drilling machine 10. The method employs a horizontal directional drilling machine and dual-member drill string as previously described herein. Preferably one of the percussive tools 16 or 16A, as described herein may be used in carrying out this method.

Having determined the need for fracturing the subterranean formation, the percussive tool is attached to the second end of the drill string. The percussive tool, preferably comprising the hammer assembly, is then operated by rotating the inner member of the drill string to fracture the formation. The percussive tool is steered through the formation by clocking the percussive tool to the desired orientation.

It will of course be realized that various modifications can be made in the design and operation of the present invention without departing from the spirit thereof. Thus, while the principal preferred construction and modes of operation of the invention have been explained in what is now considered to represent its best embodiments, which have been illustrated and described, it should be understood that within the scope of the appended claims, the invention may be practiced otherwise that as specifically illustrated and described.

What is claimed is:

1. A percussive tool for use with a dual-member drill string comprising an outer member and an inner member, wherein the inner member is rotatable independently of the outer member, the percussive tool comprising:

a housing connectable with the outer member of the drill string;

a drive member rotatably supported within the housing and connectable with the inner member of the drill string, wherein rotation of the inner member drives rotation of the drive member;

a hammer assembly supported in the housing and operable in response to rotation of the drive member to generate a percussive force; and a unitary drill bit supported by the housing to receive the percussive force from the hammer assembly.

2. The tool of claim 1 wherein the hammer assembly comprises:

a hydraulic pump operatively connected to the drive member; and a hammer unit adapted to drive the tool in response to operation of the hydraulic pump.

3. The tool of claim 2 further comprising a control unit supported within the housing and adapted to regulate operation of the hammer assembly.

4. The tool of claim 1 wherein the hammer assembly comprises a rotary-driven cam assembly operatively connected to the drive member and adapted to drive the percussive tool in response to rotation of the inner member.

5. The tool of claim 4 wherein the cam assembly comprises:

first and second cam members having opposing, helically-contoured interengaging faces so that rotation of the one against the other forces the first and second cam members a distance apart;

wherein the first cam member is fixed for rotation with the drive member;

wherein the second cam member is supported non-rotatably for axial movement away from the first cam member in response to rotation of the first cam member; and a biasing means for urging the second cam member axially toward the first cam member;

whereby continuous rotation of the first cam member causes repetitive operation of the biasing means to generate repetitive percussive force.

6. The tool of claim 5 wherein the biasing means comprises at least a conical spring washer.

7. The tool of claim 5 wherein the biasing means comprises at least a compression spring.

8. The tool of claim 5 wherein the hammer assembly further comprises:

an anvil supported within the housing to receive the repetitive percussive force from the cam assembly;

wherein the bit supported by the housing receives the repetitive percussive force from the anvil.

9. The tool of claim 1 wherein the housing comprises a pin end correspondingly threaded for connection with a similarly formed outer member of a dual-member drill string, and the inner member comprises a geometrically shaped box end forming a geometrically shaped recess corresponding to the shape of the pin end of the inner member of adjacent dual-member drill string.

10. A percussive tool for use in a borehole, the tool comprising:

a housing;

a drive member rotatably supported within the housing; and a hammer assembly supported by the housing, comprising a hydraulic pump assembly and a hammer unit;

wherein the pump assembly operates in response to rotation of the drive member and is adapted to power operation of the hammer unit.

11. The tool of claim 10 further comprising a control unit supported within the housing and adapted to regulate operation of percussive tool.

12. A horizontal directional drilling machine comprising:

a rotary drive system;

a drill string having a first end and a second end;

wherein the first end of the drill string is operatively connected to the rotary drive system;

wherein the drill string comprises a dual-member drill string having an outer member and an inner member, wherein the inner member is independently rotatable of the outer member; and a percussive tool comprising:

a housing connectable with the outer member of the drill string;

a hammer assembly operatively supported in the housing and operatively connected to the inner member of the drill string so that rotation of the inner member will generate a percussive force; and a unitary drill bit supported by the housing to receive the percussive force from the hammer assembly.

13. The horizontal directional drilling machine of claim 12 wherein the inner member is solid.

14. The horizontal directional drilling machine of claim 12 wherein the dual-member drill string comprises a plurality of pipe sections, each pipe section comprising an outer member and an inner member positioned longitudinally therein, wherein the outer member has a pin end and a box end correspondingly formed for connection with the pin and box ends of adjacent pipe sections, and wherein the pipe section inner member comprises a geometrically shaped end slidably engageable with the adjacent end of the inner member of the adjacent pipe sections of the drill string.

15. The horizontal directional drilling machine of claim 12 wherein the percussive tool further comprises a drive member rotatable supported within the housing for rotation with the inner member of the drill string.

16. The horizontal directional drilling machine of claim 15 wherein the hammer assembly further comprises:

a hydraulic pump operatively connected to the drive member; and a hammer unit powered by the hydraulic pump to drive operation of the tool.

17. The horizontal directional drilling machine of claim 16 wherein the hammer unit comprises a control unit adapted to regulate operation of the tool.

18. The horizontal directional drilling machine of claim 15 wherein the hammer assembly comprises a rotary-driven cam assembly operatively connected to the drive member and adapted to drive the percussive tool in response to rotation of the inner member of the drill string.

19. The horizontal directional drilling machine of claim 18 wherein the rotary-driven cam assembly comprises:

first and second cam members having opposing, helically-contoured interengaging faces so that rotation of the one against the other forces the first and second cam members a distance apart;

wherein the first cam member is fixed for rotation with the drive member;

wherein the second cam member is supported non-rotatably for axial movement away from the first cam member in response to rotation of the first cam member; and a biasing means for urging the second cam member axially toward the first cam member;

whereby continuous rotation of the first cam member causes repetitive operation of the biasing means to generate repetitive percussive force.

20. The horizontal directional drilling machine of claim 19 wherein the biasing means comprises at least a compression spring.

21. The horizontal directional drilling machine of claim 19 wherein the biasing means comprises at least a conical spring washer.

22. The horizontal directional drilling machine of claim 19 wherein the hammer assembly further comprises:

an anvil supported within the housing to receive the repetitive percussive force from the cam assembly;

wherein the bit supported by the housing receives the repetitive percussive force from the anvil.

23. A method for underground horizontal directional drilling using a horizontal directional drilling machine including a rotary drive system, a dual-member drill string having a first end and a second end, wherein the rotary drive system is attached to the first end of the drill string, the drill string comprising an outer member and an inner member, wherein the inner member is rotatable independently of the outer member, and wherein the machine further comprises a percussive tool comprising a housing connectable with the outer member of the drill string, a hammer assembly supported in the housing to generate a percussive force, and a unitary bit supported by the housing to receive percussive force generated by the hammer assembly, the method comprising:

operating the hammer assembly by rotating the inner members.

24. The method of claim 23 wherein the percussive tool is a steerable bent sub, wherein the method comprises clocking the interconnected outer members of the drill string to a desired orientation for an interval of axial advance while operating the hammer assembly by rotating the interconnected inner members.

* * * * *